United States Patent [19]

Grams et al.

[11] 3,994,700

[45] Nov. 30, 1976

[54] APPARATUS FOR THE LOW TEMPERATURE CARBONIZATION OF FINE-GRAIN FUELS

[75] Inventors: Wolfgang Grams, Wanne-Eickel; Karl Peter, Bochum; Paul Gernhardt, Bochum; Wilhelm Danguillier, Bochum; Christian Hundeshagen, Bochum; Siegfried Pohl, Bochum, all of Germany

[73] Assignee: Dr. C. Otto & Comp. G.m.b.H., Bochum, Germany

[22] Filed: Mar. 23, 1976

[21] Appl. No.: 669,445

[30] Foreign Application Priority Data

Mar. 21, 1975 Germany ..... 2512500

[52] U.S. Cl. ..... 48/86 R; 165/120; 202/117; 202/221

[51] Int. Cl.[2] ..... C10J 3/30

[58] Field of Search ..... 48/76, 86 R, 202; 202/117, 119, 121, 124, 221; 165/120

[56] References Cited

UNITED STATES PATENTS

| | | | |
|---|---|---|---|
| 1,415,061 | 5/1922 | Smith et al. | 202/120 |
| 1,709,371 | 4/1929 | Piron et al. | 202/117 |
| 1,713,189 | 5/1929 | Marshall | 48/202 |
| 1,749,641 | 3/1930 | McEwen | 202/117 |
| 1,772,819 | 8/1930 | Schumacher | 48/86 R |

*Primary Examiner*—S. Leon Bashore
*Assistant Examiner*—Peter F. Kratz
*Attorney, Agent, or Firm*—Brown, Murray, Flick & Peckham

[57] ABSTRACT

Fine-grain fuel is carbonized at a low temperature by feeding the fuel from a hopper downwardly into the gap formed between two vertically-arranged, plate-type conveyors. The plates of each conveyor move downwardly while their back face surfaces bear against the wall of a heating chamber. The position of the heating chambers is controlled to maintain a narrow gap, e.g., 10–30 millimeters between the plates of the conveyors. The conveyors and heating chambers are located within a container wherein a pressure of up to 100 bars is maintained and a clear gas is passed countercurrently to the downward advancement of the fuel in the gap between the conveyors. Breaker rollers below the conveyors subdivide the carbonized fuel issuing from the gap for passage into a gasification chamber. Part of the gas yield is used as fuel for the heating chambers.

9 Claims, 4 Drawing Figures

APPARATUS FOR THE LOW TEMPERATURE CARBONIZATION OF FINE-GRAIN FUELS

BACKGROUND OF THE INVENTION

This invention relates to an apparatus for the low temperature carbonization of fine-grain fuels. More particularly, the present invention is addressed to constructing and arranging such an apparatus for the production of tar-free or least low-tar, low-temperature carbonized fuel, e.g., char from coal of any kind including high caking coal, so that the char or other fuels delivered from such apparatus has a particle size suitable for introduction in one heat into a gasifier, preferably a solid-bed, countercurrent gas producer type of gasifier.

It is well known in the art to carry out a low temperature gasification process by heating fine-grain fuels for low temperature carbonization. For example, lignite or low caking coal has been heated to a required temperature in a low temperature carbonization bell by passing the producer gas through the coal. The producer gas is formed in a gas producer using the low temperature coke after the low temperature carbonization process. Low temperature carbonization of fine-grain coal, for example, is carried out at a temperature of 550° C or less. A more comprehensive discussion of low temperature carbonization of coal is given in "Chemistry of Coal Utilization" prepared by the Committee on chemical utilization of coal, Division of Chemistry and Chemical Technology, National Research Council Committee, H.H. Lowry, Chairman, published by John Wiley & Sons, 1945.

SUMMARY OF THE INVENTION

It is an object of the present invention to provide an improved apparatus for low temperature carbonization of fine-grain fuels to produce carbonized fuel particularly char which is tar-free or at least has a low-tar content suitable for use in a gasifier preferably a solid-bed, countercurrent gas producer.

It is a further object of the present invention to provide an apparatus which is constructed and arranged to carry out a low temperature carbonization process to form low temperature coke from coal, especially caking coal, inter alia while at the same time providing that the char has a particle size suitable for use in one heat in an immediately following gasification process by a solid-bed gas producer.

More specifically, according to the present invention there is provided an apparatus for the low temperature carbonization of fine-grain fuel, the apparatus including the combination of means including a plurality of plates adapted to move downwardly along each of two spaced-apart courses of travel, the plates moving along each course of travel having face surfaces forming one of the opposed sides of a gap wherein fine-grain fuel undergoes low temperature carbonization while the fuel is advanced downwardly by the plates, a heating chamber having a vertical wall bearing against the back surfaces of the plates while moving along each course of travel to heat the fine-grain fuel in the gap, means above the plates for introducing fine-grain fuel into the gap, and withdrawal means below the plates to receive the carbonized fuel issuing from the gap.

Thus, according to the present invention there is provided a low temperature carbonization apparatus characterized by the use of plates which are disposed opposite one another and kept in continuous downward movement while forming a gap between the plates. The walls of the heating chambers bear against the back surfaces of the plates with the application of pressure. Means are employed for introducing fuel and for withdrawing the resulting low temperature coke at the top and bottom ends of the gap. According to the present invention, the plates used to form the gap are part of endless belts or conveyors extending between top and bottom reversing and drive wheels. Preferably, means for breaking the withdrawn pieces of low temperature coke are disposed beneath the gap. Such means may consist of uneven guide plates or breaker rollers carrying interfitting members that extend radially from the rollers.

A suitable width for the gap between the downwardly moving plates is within the range of 10–30 millimeters. The height of the low temperature carbonization apparatus is preferably within the range of 2–3 meters. Given such dimensions for a low temperature carbonization apparatus, the low temperature coke is obtained in the form of pieces that are adequately solid and have only a small portion of dust and fine-grain particles. This form of carbonized fuel is usable in a gas producer bed and suitable for the passage of a gaseous gasification agent, e.g., air, oxygen-enriched air, mixtures of air and water vapor or oxygen and steam.

Some of the current of clear gas obtained from the gas producer is passed, if desired, through the fuel undergoing low temperature carbonization in the gap formed between the conveyors. Such use of a current of clear gas serves both to supply heat to the fine-grain fuel and to dissociate the gasification products. This latter feature can also be achieved by the passage of water vapor or of the low temperature carbonization gas from which tar has been completely or partially removed. The gas liberated from the gap between the downwardly-movable plates is subjected, in a known manner, to condensation. This produces the low temperature carbonization products and particularly, low temperature tar. If the tar content of the discharged material is still too high, such material can also be introduced into a low temperature carbonization shaft before further processing. Further removal of the tar takes place by means of a scavenging gas.

According to the present invention, the low temperature carbonization apparatus together with a gas producer if required at the discharge end thereof, may be located in a tank wherein an elevated pressure is maintained. The pressure in the tank is between 0.3 and 100 bars, preferably within the range between 0.5 and 40 bars. By employing the apparatus of the present invention, the low temperature carbonization process is carried out within a very short time which is of the order of a fraction of an hour. This is because of the small thickness of the bed of fuel in which the fine-grain fuel is subjected to heating since the thickness of the bed corresponds to the width of the gap formed between the downwardly-moving plates which, as previously described, is relatively small. Further contributing to the speed at which the low temperature carbonization process occurs is the simultaneous use of indirect heating by the heating chambers together with the possibility of adding scavenging gas heating provided by the clear gas from gasification or some other preheated scavenging agent. Rapid low temperature carbonization also promotes caking of the material and the formation of pieces of coke while at the same time obtaining a high yield of high grade dissociated products.

These features and advantages of the present invention as well as others will be more readily understood when the following description is read in light of the accompanying drawings, in which.

Figure 1:
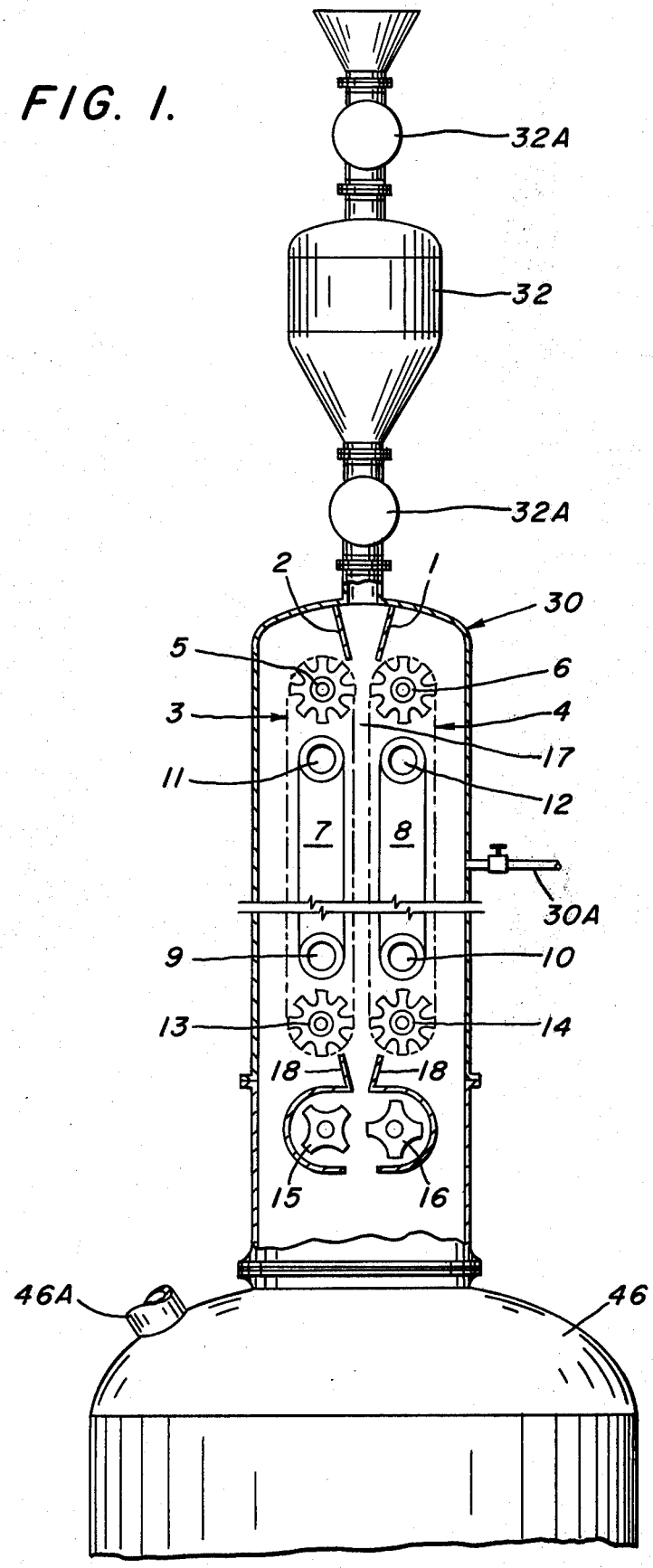
FIG. 1 is a vertical sectional view of a carbonization apparatus enclosed in a pressurized tank according to the present invention.
Figure 2:
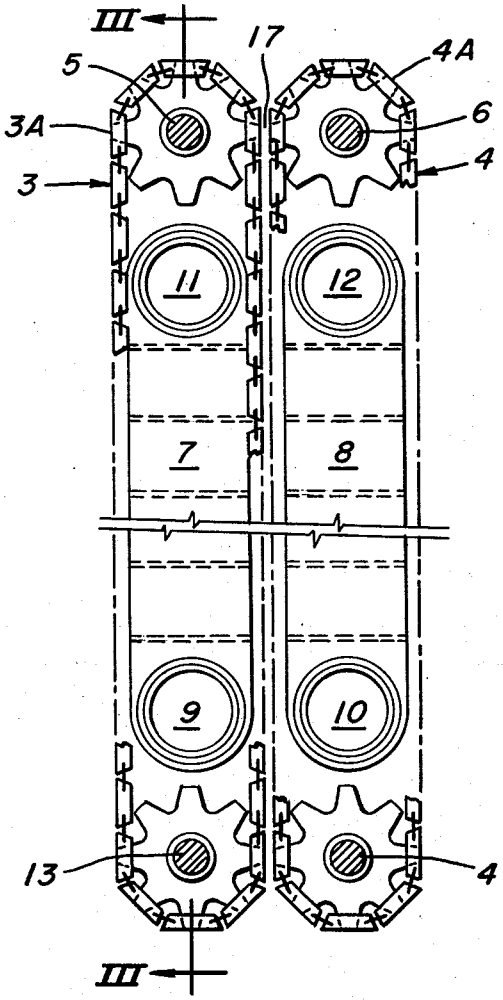
FIG. 2 is an enlarged view of the low temperature carbonization apparatus shown in FIG. 1.

As shown in FIG. 1, guide plates 1 and 2 form a funnel-like guide at the top of a space enclosed by a pressurized tank 30 wherein an elevated pressure is maintained by a gaseous supply line 30A including a valve which is adjusted to maintain a selected elevated pressure within the range of 0.3 and 100 bars, preferably within the range of between 0.5 and 40 bars within the tank. The guide plates 1 and 2 direct fine-grain fuel from an overlying hopper 32 which includes suitable pressure locks 32A for introducing the fine-grain fuel into the carbonization apparatus while an elevated pressure is maintained within the tank 30. The guide plates 1 and 2 direct the fine-grain fuel to undergo carbonization into a gap 17 formed between two spaced-apart plate conveyors 3 and 4. As shown in FIG. 2, these conveyors include a plurality of elongated plates 3A and 4A, respectively. The plates of each conveyor are rectangularly shaped and pivotally interconnected in a side-by-side relation to form an endless-type conveyor. The plate conveyors 3 and 4 include top rollers 5 and 6, respectively, and bottom rollers 13 and 14, respectively, to direct the plates of the conveyors so that they form a narrow elongated gap 17 wherein fine-grain material is advanced slowly in a downward direction by the movement of the conveyor plates. A suitable conveyor drive is provided for rotating at least one of the rollers for each conveyor. It will be understood, of course, that the fine-grain material to undergo low temperature carbonization is advanced by the conveyor from the top portion thereof beginning at rollers 5 and 6 to the bottom portion at rollers 13 and 14. Each run of the conveyors travels in a downward direction at the gap between them. A heating chamber is provided between the downward run and the return run of each conveyor.

Figure 4:
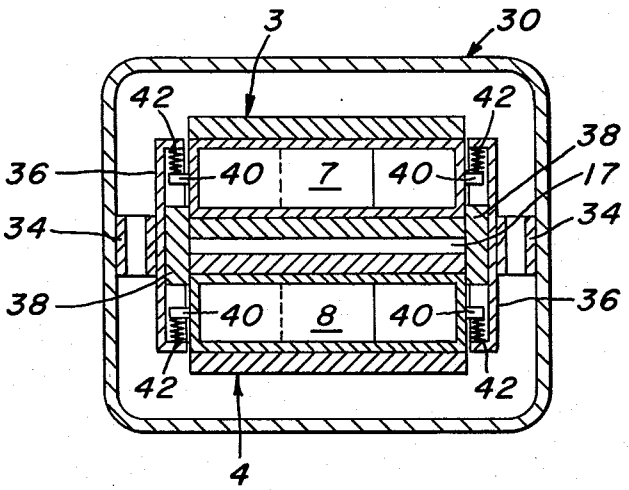
FIG. 4 is a sectional view taken along line IV—IV of FIG. 3.
Figure 3:
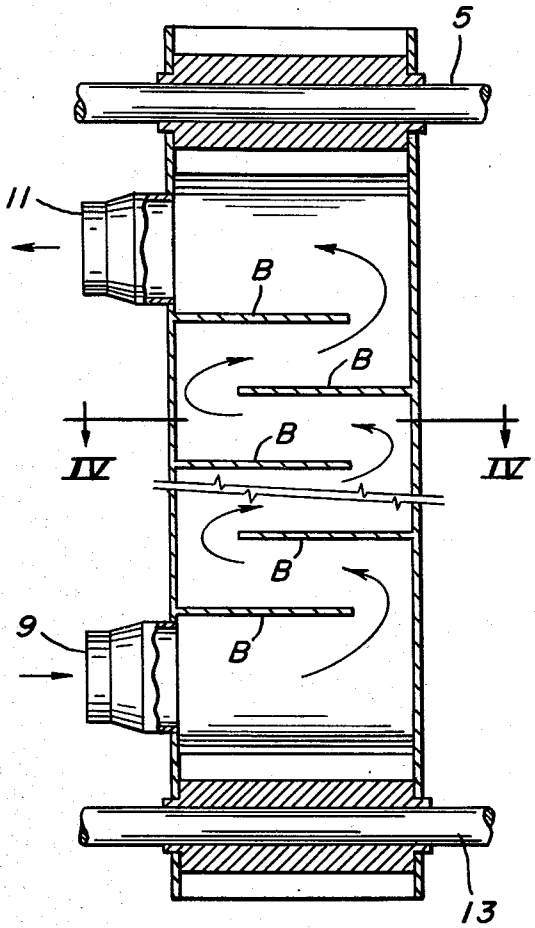
FIG. 3 is a sectional view taken along line III—III of FIG. 2.

As clearly shown in FIGS. 2–4, heating chambers 7 and 8 are located between the two runs of each conveyor. Each heating chamber includes internal baffle plates B used to pass the gaseous heating medium back and forth along the height of the heating chambers which, as previously indicated, lies within the range of 2–3 meters in length. The gaseous heating medium enters the heating chambers at 9 and 10 and the waste gases are exhausted from the heating chambers by gas outlets 11 and 12.

In the example shown in FIG. 4, brackets 34 are carried in an opposing manner by the inside wall of the tank 30. These bracket plates, in turn, are secured to U-shaped support members 36. End plates 38 are secured within the hollowed out area provided by the U-shaped members 36. The end plates 38 cooperate with the outer edges of the plates 3A and 4A while moving along the downward run of the conveyors to thereby form a closure to the outer edges of the gap 17. Lugs 40 extend from the opposite ends of the heating chambers into the hollowed-out area of the U-shaped members 36. Springs 42 or threaded adjustable members, are arranged between each lug 40 and a projecting leg of the U-shaped members 36 for pressing the heating chambers 7 and 8 inwardly against the downwardly-moving run of the plate conveyors 3 and 4. By this construction and arrangement of parts, the width of the gap 17 is determined wherein the fine-grain fuel undergoes carbonization. The carbonized material issuing from the gap 17, having undergone low temperature carbonization, is directed by guide plates 18 (FIG. 1) toward roller members 15 and 16. These roller members have longitudinal corrugations formed by radial extensions. The rollers 15 and 16 are used to subdivide the carburized fuel after which the subdivided fuel passes directly into an underlying gasifier 46. Such a gasifier, as previously described, may be in the form of a gas producing bed because the size of the low temperature carbonization products is such that gaseous gasification agents can be passed through the bed of carbonized fuel. A conduit pipe 46A coupled to the gasifier 46 is used for supplying at least part of the clear gas from the gasifier for combustion within the heating chambers. Moreover, a portion of the clear gas from the gasifier may be passed, if desired, upwardly in a countercurrent manner to the downward advancement of the fine-grain fuel by the plate conveyors within tank 30.

Fine-grain fuel suitable for low temperature carbonization by employing the apparatus of the present invention includes not only fine-grain coal or lignite, but also fuel such as used rubber, plastic waste and commercial refuse are suitable after appropriate comminution and processing.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. Apparatus for the low temperature carbonization of fine-grain fuel, said apparatus including the combination of:

means including a plurality of plates adapted to move downwardly along each two spaced-apart courses of travel, said plates having face surfaces forming one of the opposed sides of a gap wherein fine-grain fuel undergoes low temperature carbonization while advanced downwardly by the plates, a heating chamber having a vertical wall bearing against the back face surfaces of said plates while moving along each course of travel to heat the fine-grain fuel in said gap, means above said plates for introducing fine-grain fuel into said gap, and withdrawal means below said plates to receive the carbonized fuel issuing from said gap.

2. The apparatus according to claim 1 wherein said means including a plurality of plates further includes means interconnecting the plates to form an endless conveyor at each course of travel, and drive means including upper and lower rollers for the interconnected plates forming each endless conveyor.

3. The apparatus according to claim 1 wherein said withdrawal means includes breaker members to subdivide the carbonized material issuing from said gap.

4. The apparatus according to claim 1 wherein said withdrawal means includes spaced-apart breaker rollers having interfitting, radially-extending members for subdividing the carbonized material issuing from said gap.

5. The apparatus according to claim 1 further including position control means to maintain a gap within the range of 10 to 30 millimeters between said plates while moving downwardly along said two courses of travel.

6. The apparatus according to claim 1 wherein the vertical walls of said heating chambers have a height of between 2 and 3 meters to bear against the back surfaces of said plates for heating a corresponding height of fine-grain fuel in said gap.

7. The apparatus according to claim 1 further including a tank enclosing said means including a plurality of plates and the heating chambers while bearing against the back surfaces of said plates, said container being coupled to means for maintaining a pressure therein of between 0.3 to 100 bars.

8. The apparatus according to claim 1 further including gasification means for supplying a current of clear gas, said gasification means discharging clear gas in a countercurrent manner to the downward advancement of the fine-grain fuel by said plates within said gap.

9. The apparatus according to claim 1 further including gasifier means receiving the carbonized fuel issuing from said withdrawal means for producing a supply of clear gas, and conduit means for supplying at least part of the clear gas for combustion within said heating chamber.

* * * * *